US005363975A

United States Patent [19]

Meade

[11] Patent Number: 5,363,975

[45] Date of Patent: Nov. 15, 1994

[54] CLOTHES DRYER LINE TENSIONING DEVICE

[75] Inventor: Ronald G. Meade, Seaton, Australia

[73] Assignee: Hills Industries Limited, Edwardstown, Australia

[21] Appl. No.: 8,456

[22] Filed: Jan. 25, 1993

[30] Foreign Application Priority Data

Jan. 24, 1992 [AU] Australia ..... PL0544

[51] Int. Cl.[5] ..... A47F 5/00

[52] U.S. Cl. ..... 211/197; 211/119.01

[58] Field of Search ..... 211/197, 196, 119.01, 211/119.03, 119.15, 119.09

[56] References Cited

U.S. PATENT DOCUMENTS

| | | | |
|---|---|---|---|
| 4,583,649 | 4/1986 | Brown | 211/197 X |
| 4,735,322 | 4/1988 | Steiner | 211/197 X |
| 5,240,128 | 8/1993 | Ohm | 211/197 |

FOREIGN PATENT DOCUMENTS

| | | |
|---|---|---|
| 574117 | 5/1985 | Australia . |
| 55010/90 | 11/1990 | Australia . |

*Primary Examiner*—Alvin C. Chin-Shue
*Assistant Examiner*—Sarah A. Lechok
*Attorney, Agent, or Firm*—Edward W. Callan

[57] ABSTRACT

This invention relates to a clothes line having adjustable tension and to a line tensioner which is used for the taking up slack in a clothes line. According to this invention, a clothes line dryer (10) having an adjustable line tension comprises at least two frame members (11), a line (12) extending between the frame members (11) that is fixed at least one location on the frame member (11), a plurality of line guide members (13) located on each of the frame members (11) which substantially hold the line (12) with respect to each of the frame members (11) and allow the line (12) to extend between the frame members (11) at spaced intervals along the frame members (11), but which allow longitudinal movement of the line (12) therethrough, and at least one line tensioning means (14), (15) which engage the line (12) so as to shorten its length thereby creating a desired tension in the line (12). This invention allows a line which has become slack due to loading or environmental factors to be retensioned thereby improving the appearance of a clothes line.

11 Claims, 2 Drawing Sheets

CLOTHES DRYER LINE TENSIONING DEVICE

This invention relates to a clothes line having adjustable tension and to a line tensioning device which is used for tensioning a line or for taking up slack in that line.

Preferably, the line tensioning device is used in a clothes hoist or dryer on which a line extends around a plurality of radial arms. However, it will be realised the invention need not be limited to this particular type of clothes dryer, and will be suitable for use in other types of dryers where tensioning of a line or taking up slack in a line is required.

BACKGROUND OF THE INVENTION

Figure 1:
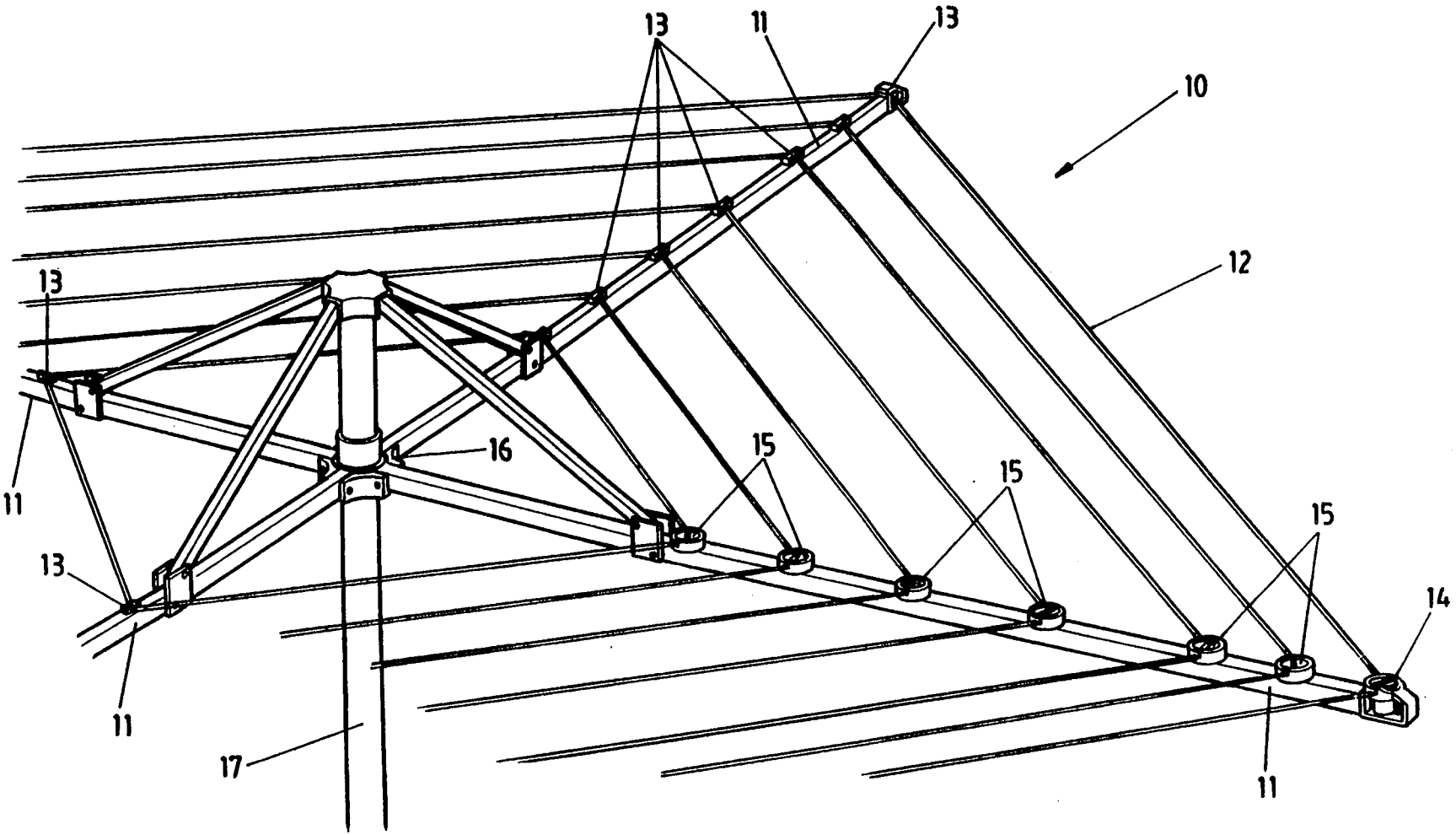

Rotary clothes lines or dryers are well known, and in particular, a common form of clothes dryer has a plurality of radial arms with line being secured to and extending between each of the radial arms. An example of such a clothes dryer is shown in FIG. 1 of our Australian Patent No 574117.

The invention referred to in Australian Patent No 574117 and the invention described in patent application No. 55010/90 is directed to solving the problem of securing line to the frame members of a clothes dryer. In both of these cases, it is important that the clothes line be securely held with respect to the radial arms so as to prevent the arms spreading when a large weight of clothes is hung on a span of line between two adjacent arms.

However, a further problem that has been encountered results from stretching of a line that extends around the radial arms of the clothes dryer. Due to environmental conditions such as high temperature and temperature variations, and as a result of relatively high loads being applied to the line during warm to hot conditions, the line will stretch, which results in the line curving and hanging between adjacent radial arms rather than being taut and stretched between the arms.

This results in a clothes dryer having an unsightly appearance, which is undesirable.

In respect of the invention disclosed in patent application No. 55010/90, it is possible to retension the line by pulling the line tight from the centre hub of the clothes dryer and gradually pulling the line tight as it extends around the radial arms and finally relocking the line in the line lock device installed in each end of each radial arm. However, this process is reasonably time consuming, and inconvenient, and therefore it is an object of this invention to provide a means of retensioning a line or taking up slack within the line which can be achieved simply and quickly.

A BRIEF DESCRIPTION OF THE INVENTION

In its broadest form, the invention is a clothes dryer having adjustable line tension comprising at least two frame members, a line extending between said frame members that is fixed at least to one location on one said frame member, a plurality of line guide members located on at least each of said frame members other than said one said frame member, which line guide members substantially hold said line with respect to each said frame member and allow said line to extend between said frame members at intervals spaced along said frame members, but which allow longitudinal movement of said line therethrough, and at least one tensioning means engaging said line so as to shorten its length thereby creating a desired tension in said line.

Preferably, the guide members comprise eyelets which are attached to frame members. However, an equally suitable guide member may comprise an aperture through the frame members at the required locations. The function of the guide members is to hold the line with respect to the frame members such that adjacent lines may be held in a spaced relationship, while at the same time allowing longitudinal movement of the line through the guide member when the tensioning members are operated to take up slack line thereby increasing the tension in the line.

The eyelets preferably comprise an aperture through which the line passes, but also comprise an opening which allows the line to be located in the eyelet without having to feed an end of the line therethrough. Such an eyelet is described in the earlier Australian Patent Application No 55010/90.

Preferably, the line tensioning means is attached to a frame member, however the scope of this invention is to include a tensioning means that is attached to the line and located between adjacent frame members. Preferably, the tensioning means comprises a capstan wheel around which the line is wound so as to take up slack line thereby tensioning the line between adjacent frame members.

The capstan wheel is provided with a non return means which enables the capstan to be rotated in one direction for taking up slack line while at the same time preventing rotation of the capstan in the opposite direction. Preferably, the non return means comprises a ratchet mechanism which is associated with the capstan.

Preferably, the tensioning means may comprise a body having a cylindrical recess within which the capstan is journalled for rotation. A pair of slots may be provided in the body which allow line to pass through the body so as to locate around the capstan wheel. In order to facilitate attachment of the line to the capstan wheel, a slot may be provided across the top surface of the capstan wheel within which the line locates. Upon rotation of the capstan wheel, the line is caused to wrap around the outer peripheral surface of the capstan wheel. The use of such a slot also prevents slippage of the line with respect to the capstan wheel.

In the case where a capstan wheel is located within a recess of a body, the non return mechanism may comprise a plurality of tapered recesses on the undersurface of the capstan wheel, and at least one projection within the body which engages within the recesses so as to allow the capstan wheel to rotate in one direction but to prevent rotation in the opposite direction.

Preferably, the tension means may be moulded in plastic, and one tension means may be adapted to locate to the end of a frame member, and another tension means may be adapted so as to locate on the upper surface of a frame member.

DESCRIPTION OF THE DRAWINGS AND A PREFERRED EMBODIMENT OF THE INVENTION

Figure 2:
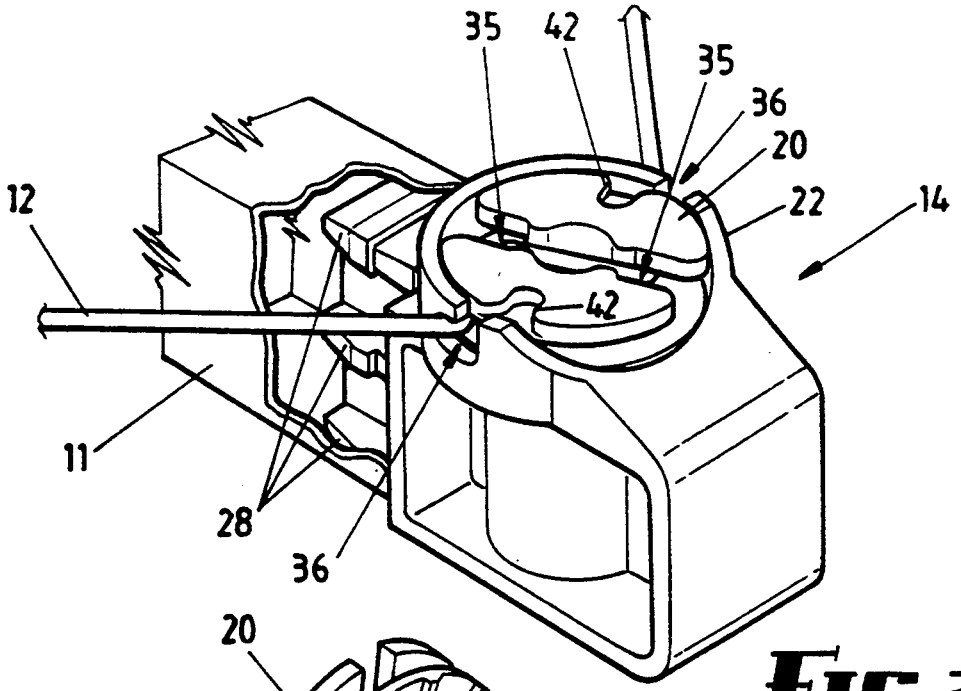
Figure 3:
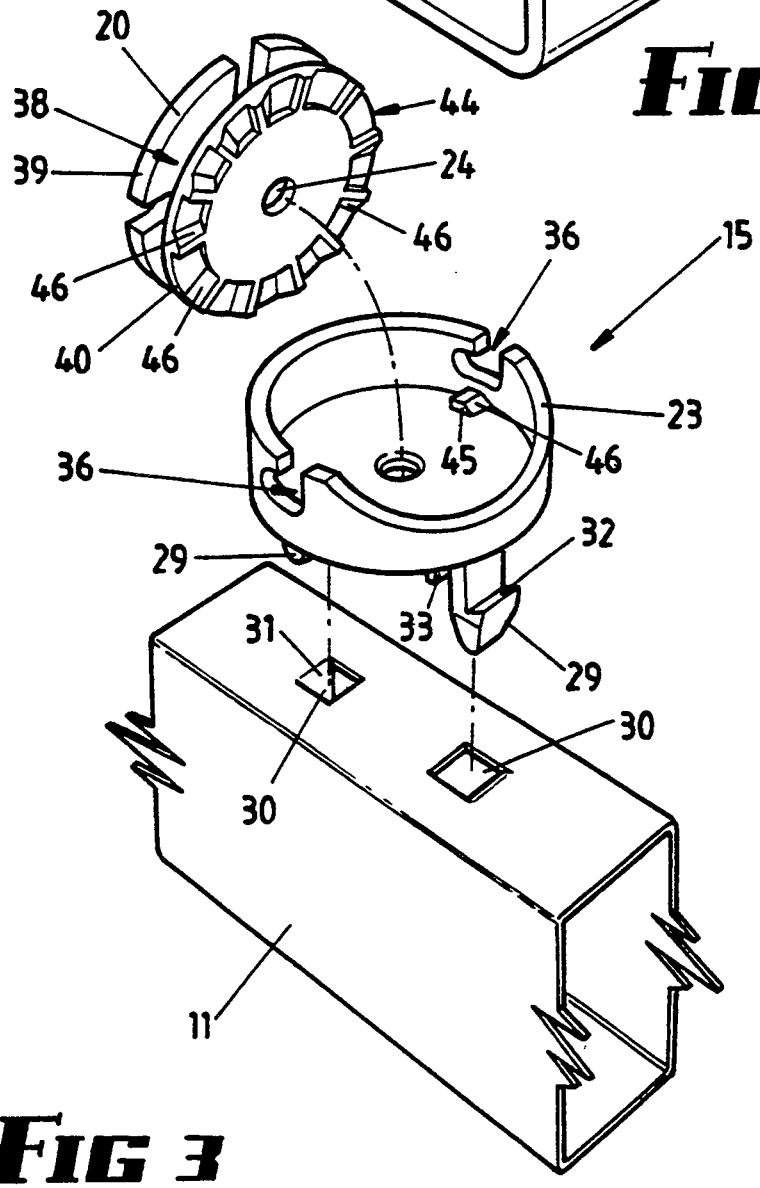

In order that the invention may be more readily understood, a preferred embodiment will now be described. However, it should be realised that the invention is not to be confined or restricted to the precise details of this embodiment. This embodiment is illustrated in the accompanying representations in which:

FIG. 1 shows a part perspective view of a clothes dryer with tensioning means located along one of the radial arms, FIG. 2 shows a tensioning means adapted for location in the end of a radial arm, and FIG. 3 shows a tensioning means adapted for location on the upper surface of a radial arm.

In this embodiment, the clothes dryer 10 comprises four evenly spaced radial frame members 11, a line 12, line guide means 13 at the ends of some of the radial arms 11, and spaced along the upper surface of some of the frame members 11. On one of the frame members 11, there is located at one end an end tensioning means 14, and along the upper surface tensioning means 15.

The frame members 11 are attached to a central hub 16, and the central hub 16 is supported by a standard 17.

As seen in this embodiment, the line 12 extends around the frame members 11 at a plurality of radial intervals as is defined by both the guide members 13 and the line tensioning means 15.

In this embodiment, a single length of line 12 is used on each clothes dryer 10, and either end of the line 12 is fixed with respect to one of the frame members 11 so that each of the tensioning means 14 and 15 may operate so as take up any excess line thereby shortening the line length so as to create the desired tension in the line. The line guide means 13 are designed to hold the line at a particular location with respect to each of the frame members 11, but are arranged so as to allow longitudinal movement of the line through each of the line guide means 13. This allows the slack in the line 12 around any one circuit of the clothes dryer 10 to be taken up by the tensioning means 14 and 15.

In this embodiment, one end of the line 12 may be fixed with respect to the end of a first radial arm substantially in accordance with the method referred to in the earlier Australian Patent Application No 55010/90. The line then extends around the remaining ends of the radial arms, one of which incorporates the end tensioning means 14. When the line 12 returns to the first frame member 11 where the end of the line 12 is fixed, the line is again secured to the end of the radial arm 11, and extends inwardly towards the hub 16 to the next adjacent line guide member 13. The line then extends around the frame members 11 passing through the line guide members 13, and through a tensioning means 15 until again it returns to its starting point whereupon the line is located in the guide member 13 and directed inwardly towards the central hub 16. This process continues at each respectively inwardly located line guide means 13 and tensioning means 15 such that the line 12 is installed on the frame members 11 in a series of loops that are evenly spaced. The end of the line 12 is then secured to one of the frame members 11 thereby completing installation of the line 12 to the clothes dryer 10.

Initially, the line 12 can be installed to the clothes dryer 10 with the desired tension, or alternatively the desired tension can be created by operation of the tensioning means 14 and 15. Upon operation of the tensioning means 14 and 15, the line 12 then becomes fixed with respect to the tensioning means 14 and 15 such that the line cannot move longitudinally with respect to the tensioning means 14 and 15. As the line sags or stretches through normal use, the tension can be re-adjusted by operation of the tensioning means 14 and 15.

As can be seen in FIG. 2 and 3, the tensioning means 14 and 15 comprise a capstan wheel 20 which is journalled for rotation with respect to an end body 22 in respect of an end tension means 14, and to a body 23 in respect of a tension means 15. In both cases, the bodies 22 and 23 are provided with a cylindrical recess within which the capstan 20 is journalled for rotation. In this embodiment, the capstan 20 and end bodies 22 and 23 are provided with apertures 24 and 25 through which a rivet (not drawn) is located so as to allow rotation of the capstan 20 with respect to the body 22 and 23.

As shown in FIG. 2, the end tensioning means 14 is provided with three barbed spigots 28 which enable the end tensioning means 14 to be located within the end of a tubular frame member 11. The barbed spigots 28 have an interference fit with respect to the internal dimensions of the frame member 11. The spigot 28 is forced within the tube of the frame member 11 thereby holding the end tensioning means 14 rigidly in place.

In respect of the tensioning means 15 which is located on the upper surface of the frame member 11, there are a pair of downwardly directed barbs 29 which locate within recesses 30 which are formed in the upper surface of the frame member 11. The recesses 30 are formed by a punching operation which leaves a downwardly depending tab 31 located within the aperture 30. The lower end of the tab 31 locates against the barb surface 32 thereby securing the body 23 to the frame member 11. Two secondary barbs 33 are provided which abut against the edge of the aperture 30 adjacent to the tab 31 thereby preventing lateral movement of the body 23 with respect to the frame member 11.

As seen in FIG. 2, the capstan 20 is provided with a slot 35 which extends across the upper surface of the capstan 20. In addition, the bodies 22 and 23 are provided with slots 36 for location of the line 12. In the process of installing the line 12 to the clothes dryer 10, the slot 35 may be aligned with the slots 36 such that the line can be placed into the slot 35. The line 12 is then taken up on the capstan 20 upon further rotation. The capstan 20 has a peripheral groove 38 formed between upper flange 39 and a lower flange 40. As the capstan 20 is rotated, the line 12 is taken up within the peripheral groove 38. As can be seen in FIG. 2, due to the close fit between the outer diameter of the capstan wheel 12 and the inner diameter of the recess within the bodies 22 and 23, once the line 12 is wound onto the capstan 20, it cannot be readily dislodged.

The upper flange 39 of the capstan 20 may be provided with a pair of recesses 42 which enable the location of a manual tool (not drawn) which allows rotation of the capstan 20. The tool may be designed to locate within either the recesses 42 and the slot 35, and may comprise a plate having two projections that engage recesses 42 and an elongate projection that locates within slot 35. The upper surface of the plate is provided with an upstanding flange or key for manual turning of the tool once it is engaged.

A non return mechanism is incorporated between the capstan 20 and the bodies 22 and 23 which prevent unwinding of the capstan 20 once the desired tension is created in the line 12. The non return mechanism is illustrated in FIG. 3, and in this embodiment comprises a ratchet style mechanism comprising a plurality of recesses 44 located in the underside surface of the lower flange 40, and a pair of projections 45 within the bodies 22 and 23. As seen in FIG. 3, only one of the projections 45 is illustrated, the other projection 45 being adjacent the opposite slot 36. Both the recesses 44 and the projections 45 are provided with tapered surfaces 46 which enable the capstan 20 to rotate in one direction such that the recesses 44 will pass the projections 45 in one direction, but will prevent rotation of the capstan in the other direction. In order to allow the recesses 44 to pass the projections 45, the lower flange 40 is sufficiently resilient to allow upward flexing which in turn allows the recesses 44 to pass the projections 45.

As mentioned above, once the line 12 is installed within the capstan wheel 20, then the line is effectively locked with respect to the tensioning means 14 and 15. In an alternative method of installing the line to the clothes dryer 10, line tensioners 15 can be located in the ends of two of the frame members 11, with line guide means 13 being installed in the ends of the remaining frame members 11. The frame members 11 with the guide members 13 in the ends thereof can be located opposite one another and between the first two frame members 11 with the line tensioners 15 located in the end thereof. This ensures that the line 12 is locked with respect to two of the ends of the frame members 11, thereby assisting in maintaining even radial spacing of the radial arms 11. Alternatively, the two frame members, instead of having line guide means 13 located therein, may be provided with line locks which hold the line 12 with respect to the ends of the two frame members 11. The line 12 is in turn locked with respect to the tension members 14, thereby ensuring even radial spacing of the frame members 11.

As will be seen from the above description, the invention provides convenient and easy means of tensioning line within a clothes dryer, thereby providing a neat and tidy appearance to the clothes dryers, particularly when not in use.

I claim:

1. A clothes dryer having adjustable line tension, comprising:

at least two frame members, a line extending between said frame members that is fixed at least to one location on one said frame member, a plurality of line guide members located on at least each of said frame members other than said one said frame member, which line guide members substantially hold said line with respect to each said frame member and allow said line to extend between said frame members at intervals spaced along said frame members, but which allow longitudinal movement of said line therethrough, and at least one tensioning means engaging said line so as to shorten its length thereby creating a desired tension in said line.

2. A clothes dryer according to claim 1 wherein said line guide members comprise apertures within said frame member.

3. A clothes dryer according to claim 1 wherein said line guide members comprise eyelets which are attached to said frame members.

4. A clothes dryer according to claim 1 wherein said tensioning means is attached to said frame member.

5. A clothes dryer according to claim 1 wherein said tensioning means comprises a capstan wheel around which said line is wound for tensioning thereof and non return means which allow said capstan to rotate in one direction, but prevents rotation in the other direction.

6. A clothes dryer according to claim 5 wherein said capstan has a slot extending across its upper surface such that said line may locate within said slot so as to engage said line with said capstan.

7. A clothes dryer according to claim 6 wherein said tensioning means further comprises a body having a cylindrical recess within which said capstan is journalled for rotation, and two slots within the body to allow line to pass therethrough.

8. A clothes dryer according to claim 7 wherein said non return means comprises a ratchet mechanism between said body and said capstan.

9. A clothes dryer according to claim 8 wherein said ratchet mechanism comprises a plurality of tapered recesses on the undersurface of said capstan and at least one projection on said body for engaging said tapered recesses.

10. A clothes dryer having adjustable line tension comprising, four evenly spaced radial frame members extending from a central hub, a line, fixed to the end of a first radial arm extending around said radial arms, line guide members located at the end of second, third and fourth radial arms, and spaced along three of said radial arms which substantially hold said line with respect to each said frame member, but which allow longitudinal movement of said line therethrough, tensioning means located in the end and along one said radial arm that engage said line and shorten its length so as to create the desired tension in said line wherein said line extends from its fixed point around the ends of said frame members, one of which comprises a tensioning member whereupon it returns to the fixed point and extends down the radial arm to a line guide member, whereupon (i) it extends around said radial arms through the line guide members and through a tensioning member whereupon once it completes a full circuit of said radial members (ii) it extends down a radial arm, steps (i) and (ii) being repeated until said line nears said central hub, whereupon the end of said line is fixed to one of said frame members.

11. A clothes dryer according to claim 10 wherein line tensioners are located in the ends of two of said frame members, and line guide means in the ends of remaining frame members which are opposite one another and between said first two frame members.

* * * * *